US006142543A

United States Patent [19]

Friberg

[11] Patent Number: 6,142,543

[45] Date of Patent: Nov. 7, 2000

[54] DEVICE FOR COLLECTING DEBRIS

[76] Inventor: Nelson Friberg, 51-1D Taurus Dr., Somerville, N.J. 08876

[21] Appl. No.: 09/146,698

[22] Filed: Sep. 2, 1998

[51] Int. Cl.[7] ..... A01K 29/00; E01H 1/12

[52] U.S. Cl. ..... 294/1.4; 15/257.1

[58] Field of Search ..... 294/1.1, 1.3–1.5, 294/55; 15/257.1, 257.6, 257.7, 257.9, 104.8; 248/95, 99, 100, 101

[56] References Cited

U.S. PATENT DOCUMENTS

| | | | |
|---|---|---|---|
| D. 267,593 | 1/1983 | Crawford et al. | 294/1.4 |
| 3,754,785 | 8/1973 | Anderson | 294/55 |
| 4,360,229 | 11/1982 | Kinney | 294/1.4 |
| 4,457,549 | 7/1984 | Lowery | 294/1.4 |
| 4,986,587 | 1/1991 | Lozano | 294/1.4 |
| 5,033,781 | 7/1991 | Flood | 294/1.4 |
| 5,503,442 | 4/1996 | Lee | 294/1.4 |

*Primary Examiner*—Dean J. Kramer

[57] ABSTRACT

The subject device is an apparatus used to assist in the collection of debris, particularly debris that is on the ground or on the floor, such device comprising a hand-held member adapted to temporarily hold a flexible container thereon, the opening of which container is exposed on the forward portion of member so that debris on the ground can be collected in a scooping manner into the container without the need of manually retrieving same or without the need of external objects to help push the debris into the container, such apparatus having a base member apparatus in a position to hold the container with its opening being exposed in a position to receive debris.

5 Claims, 2 Drawing Sheets

DEVICE FOR COLLECTING DEBRIS

DISCUSSION OF PRIOR ART AND BACKGROUND OF INVENTION

The subject invention relates to those types of devices that are used to scoop up litter and debris strewn over the ground or on a floor. Such devices are used primarily for the purpose of assisting a person clearing debris from the ground or a floor, for example, so as to avoid the unpleasant task of bending over and manually retrieving particular types of debris for placement in a container for ultimate disposal. Such devices are used frequently for the purpose of scooping up animal waste and debris.

In this respect, there are several devices that are presently in existence adapted specifically for the task of assisting in the process of retrieving litter and debris from the ground or floor areas. Some structures comprise a simplistic structural arrangement that permits a manual scooping action to pick up debris, often requiring the assistance of an external aid to push the debris into a holding container. Other devices have evolved into more sophisticated structures.

Many such devices have been used and are presently being utilized particularly for retrieving animal waste from the ground area. Many of these devices employ simple scooping members that require multiple manual movements to accomplish the necessary waste clearing tasks. Some employ attached fixed containers while others use temporary containers. Such existing devices have proven to be cumbersome to use and thus inefficient for the intended purpose.

Moreover, one of the major problems with such existing debris collectors is that they are generally adapted, designed and structured to collect debris in a container that must be repeatedly or frequently cleaned after usage. This latter aspect is particularly applicable in collecting devices structured and used for gathering animal debris, especially animal excrement. Repeated cleaning of such collection devices is essential for sanitation purposes and this is not only unpleasant and unsanitary, it is also inefficient.

Yet another problem is experienced with the use of most debris-collectors, namely, the need to have an external member to pull or push the ground-laden debris into a container member on the collector. Use of such an external member is also cumbersome and make the overall structure awkward and inefficient to use.

There are other characteristics of existing debris collecting devices that yield difficulties and inefficiencies with their usage. These characteristics related to efficiency, sanitation aspects, ease of carrying, debris disposability problems and other adverse aspects.

Yet another aspect involving existing devices of the type that precede the subject apparatus is that such devices are complex in structure and thus expensive to manufacture or assemble. Moreover, such complex structures are generally difficult to utilize and deploy.

By reason of the stated problems, difficulty and lack of efficiency of the debris collection devices seen in the prior and existing art, the subject device has been conceived as a structural means to overcome same and provide a more effective device in the area of debris collection, and most particularly in the area of collecting animal excrement. As a result, the following objects of the subject invention are directed accordingly.

OBJECTS

It is an object of the subject invention to provide an improved device for assisting in the collection of debris from the ground or the floor area;

An additional object of the subject invention is to provide an improved device to assist in the collection of animal excrement from the ground;

Another object of the subject invention is to provide an improved apparatus to help collect debris from the ground or floor areas without requiring the use of the hands or an external device;

Another object of the subject invention is to provide an improved process for sanitary collection of debris and animal excrement from the ground;

Still another object of the subject invention is to provide a method of improving the task of collecting and disposing of animal debris from the ground;

Another object of the subject invention is to provide a improved apparatus to hold a temporary container to be used to pick up animal debris for immediate disposal;

Still another object of the subject invention is to provide an efficient apparatus for picking up animal debris from the ground;

A further object of the subject invention is to provide a device for a person to efficiently and safely collect and dispose of animal excrement;

An object of the subject invention is also to provide a simplistic device for individuals with limited mobility to pick up debris from the floor or ground.

Other and further objects of the subject invention will become apparent on a reading of the specifications in conjunction with the claims.

DESCRIPTION OF GENERAL EMBODIMENT

The subject device is an apparatus used to assist in the collection of debris, particularly debris that is on the ground or on the floor, such device comprising a hand-held member adapted to temporarily hold a flexible container thereon, the opening of which container is exposed on the forward portion of member so that debris on the ground can be collected in a scooping manner into the container without the need of manually retrieving same or without the need of external objects to help push the debris into the container, such apparatus having a base member and affixed handle means, with container securing means affixed to a portion of the apparatus in a position to hold the container with its opening being exposed in a position to receive debris.

In a general structural perspective the subject invention has a base member with attendant handle means to manually hold the apparatus for operational purposes, with the apparatus in its most general form having container attachment means to temporarily hold a flexible container with the container's opening held open by structural means to be ready to receive in the container and with the container being ready to be detached.

DESCRIPTION OF PREFERRED EMBODIMENT

In describing the subject invention, a limited number of preferred embodiments will be described, and in this process of describing the stated embodiments, it is to be stressed that such limited description shall not be construed as limiting the scope of the subject invention, and the claims appended hereto shall not be limited by the specific description set forth herein. It is to be further noted that in making the description of the invention herein that the device shall be considered as having an upper portion and a lower portion, and that the lower portion will be that portion, for description purposes, that is to be used in proximity to the ground or floor, while the upper portion will be that portion that is most distal from the ground and will be that portion to which handle member is affixed in order to manipulate the device as desired.

Figure 1:
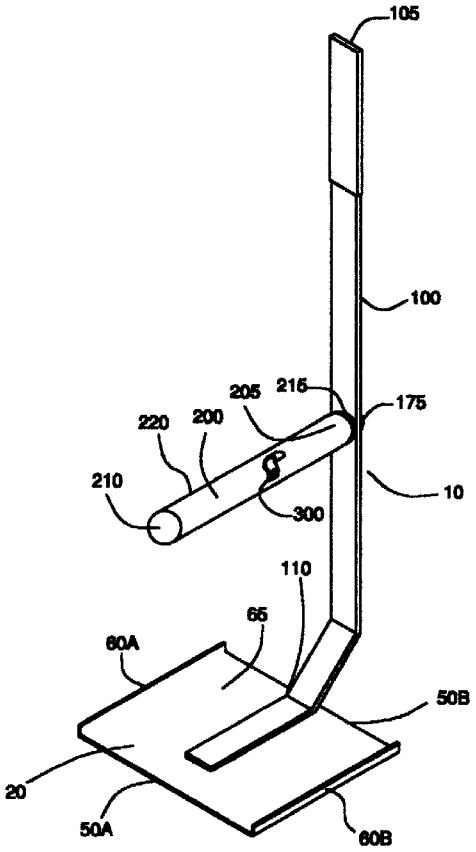
FIG. 1 is a perspective view of the subject apparatus.
Figure 2:
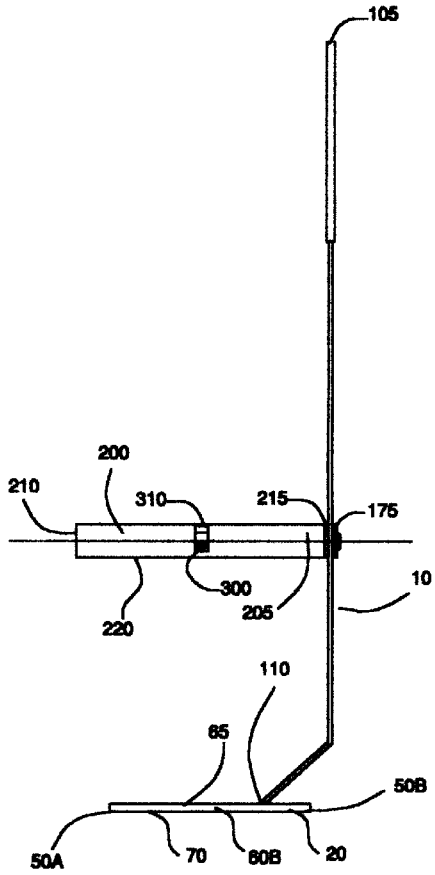
FIG. 2 is a side elevational view of the subject apparatus.

In describing the subject invention, reference will be made to the drawings in which one preferred embodiment of the subject invention is shown. Specifically, attention is addressed to FIGS. 1 and 2, in which drawings is shown a scooping apparatus 10, which scooping apparatus 10 incorporates features of the subject invention. Specifically, the scooping apparatus 10 comprises, in general, a base member 20 and an upwardly extending handle member 100, such handle member extending upwardly from the base member 20, as being affixed thereon in a temporary or permanent manner. Further, affixed to either the base member 20 or the handle member 100 is a container attachment arm 200 adapted to hold a portion of a removable flexible container that is temporarily placed on a part of scooping apparatus 10 for use to collect debris to be picked up in the temporary container 35.

In general, the subject scooping apparatus 10 can be formed in any structural manner so long as there is a portion of the device, preferably on the lower part thereof, that is structured to hold a part of a temporary container so that the opening of the container is exposed or open to face towards the debris to be scooped up and collected in the container, with the container to be disposed of after picking up the debris. Moreover, as stated in the most general embodiment, the device should have some handle mechanism or other structural attribute to permit the user to manually grasp the apparatus 10 to use it for the purposes stated, as discussed above.

In order to achieve and secure the temporary container in the form of a plastic bag to the base member, the subject invention has the following structural attributes. In describing these structural attributes, it must be stressed that there are other structural means that can be used to secure the temporary container to the base member or handle member other than those to be described below. Thus, while one preferred embodiment is used to describe the means for securing the container to the subject apparatus, other embodiments may fall within the scope of the subject invention as set forth in the claims and by perusal of this specification.

As stated, the preferred embodiment of the subject apparatus 10 is shown in the drawings, and more specifically has a base member 20 that is shown as a flat rectangular member. The shape or configuration of the base is not critical to implementation of the subject invention, as the base member may be other than rectangular and may be round, triangular or other shape as viewed from a top elevational view. Moreover, the base member need not be flat or planar shaped. In the preferred embodiment of the subject invention, the base member has a front edge 50A and a posterior edge 50B, said latter edges opposing one another. Moreover, the base member has opposing side edges 60A and 60B forming the lateral boundaries of the base member. All said described edges 50A, 50B, 60A and 60B are shown as being straight, although they may be other than straight for implementing the subject invention. For reference purposes, the frontal portion of the base member 20 will be that portion of the base member that is adjacent to the front edge 50A, while the posterior portion of the base member will be those areas of the base member adjacent the rear edge 50B. The side portions of the base member 20 are areas adjacent to the described side edges 60A and 60B. Furthermore, the base member 20, has an upper surface 65 and a lower surface 70, as seen in the drawings.

As stated, in the preferred embodiment of the subject invention a longitudinally extending handle member 100 is attached to the base member 20. The handle member 100 is used to hold, move, and manipulate the apparatus 10 in the retrieval function, while the base member 20 serves to hold a temporary, disposable container into which the debris is scooped and held for ready and almost immediate disposal together with the disposable container, as further discussed below. In the preferred embodiment the handle member 100, has means thereon to secure the container 35 to the apparatus 10.

More particularly, integrally affixed to the posterior portion of the base member 20 is a longitudinally extension handle member 100. Handle member 100 has a first end 105 and a second end 110, with the second end of said handle member being affixed to a portion of the base member, such position being preferably the posterior portion of the upper surface 65 of the base member 20 in order that the handle member 100 does not block access to the major portion of the base member for purposes of securing a debris container thereon for operational purposes. This location of the attachment of the handle member may vary, however.

In the particular embodiment shown in the drawings, the longitudinally extending handle member 100 when affixed to the base member 20 is generally and preferably substantially upright, or substantially vertically disposed. As more clearly demonstrated by the drawings, when the handle member 100 is affixed to the base member 20, the longitudinal central axis of the handle member is preferably, but not necessarily, aligned in a general perpendicular manner to the upper planar surface 65 of the base member 20 with the first end 105 of the handle member being the highest vertical portion of apparatus 10. In this preferred arrangement, when the handle member is held in a generally upright, vertical position relative to the base member 20, or more particularly the upper and lower surfaces of the base member 20, as can be seen in the drawings. It must be stated that the handle member may be disposed in a position other than the perpendicular position thusly described.

For the purposes stated, the subject apparatus 10 is structured to hold a temporary container 35, such as a small plastic bag of conventional construction, being enclosed except for an opening 40 at one end through which opening debris is moved into the interior spatial area of the temporary container. The temporary container is adapted to be placed on or around or somehow affixed to the base member 20 so that the opening 40 of temporary container 35 can face any direction from the base member 20. In the preferred embodiment of the subject invention, however, the temporary container 35 is placed over and around the base member in such a manner that the opening of the temporary container faces towards the front edge of the base member and the circumferential edge 45 of the opening 40 is drawn open and is aligned with the front edge 50A of the base member 20. In this position, the temporary container 35 is then secured to the base member 20, as more fully described below, and as explained the opening 40 of the temporary container 35 will be held partially or fully open to receive debris through such opening of the temporary container 35 to the interior spatial area 46 of the such container. These particular aspects will be discussed more fully below.

Figures 3, 4:
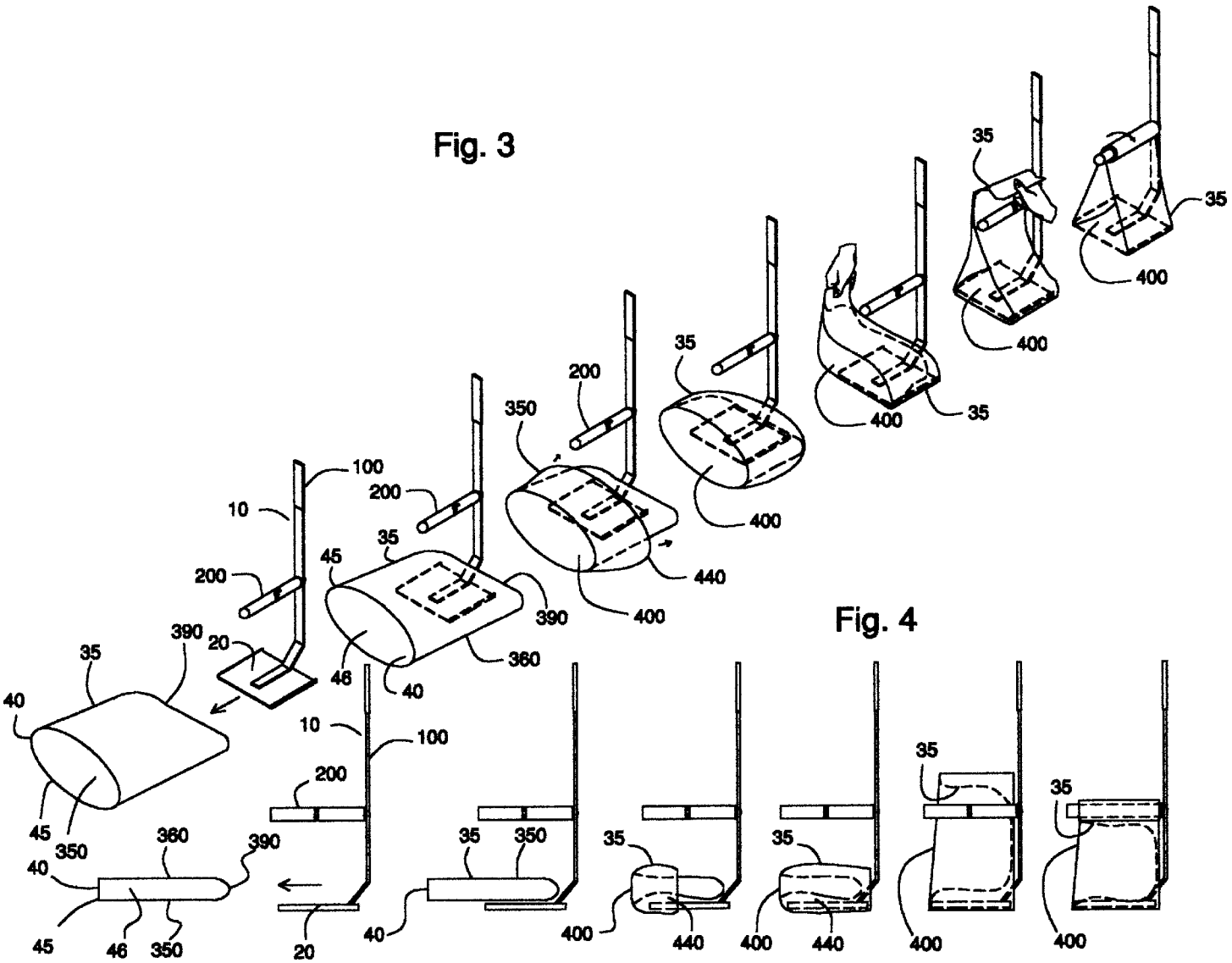
FIG. 3 is a perspective view showing the progressive steps of attaching an open container member to the subject apparatus.
FIG. 4 is a side elevational view in section showing the progressive steps used in attachment of the open container to the subject device.

As further seen in the drawings, and particularly FIGS. 3 and 4, mounted and otherwise affixed to a portion of the upright handle member 100 is a longitudinally extending container attachment arm 200. The container attachment arm has a first end 205 and a second end 210 with at least the first end being of general cylindrical configuration so as to be insertible and rotatably mounted into a mating cylindrical opening 215 formed in the frontally facing portion of the upright handle member 100, as seen. More specifically, as seen the longitudinally extending attachment arm 200, has a longitudinal central axis and is rotatably mounted to a portion of the upright handle member 100, so that the attachment arm 200 can be manually or otherwise rotated relative to the handle member 100, as needed, and as more fully explained hereafter. For this latter structural purpose, as seen in the drawings, it can be observed that the outer surface 220 of the attachment arm 200 is preferably cylindrical and with the second end 210 of the attachment arm 200 preferably projecting toward the frontal area of the apparatus 10.

More particularly, a cylindrically-shaped opening 175 is formed in that surface portion of the handle member 100 that faces towards the front of the base member 20. This cylindrical opening may extend partially or completely through the handle member and such opening is adapted to conformingly receive the cylindrically shaped first end of the longitudinally extending attachment arm 200. By this relationship, the attachment arm is rotatably mounted into a portion in the cylindrical opening 175 in handle member 100. This permits the container attachment arm to be rotated manually relative to the handle member 100. This rotation occurs by manually moving the container attachment arm.

Integrally disposed on the outer circumferential surface of the container attachment arm 200 is container attachment member 300 structured and adapted to grasp and hold a portion of the temporary container member 35 that is to be held and drawn over the base member 20, and thence rolled in part around the attachment arm 200. This attachment member 300 may take various shapes, forms, or structures so long as such attachment means is able to grasp and hold a portion of the container 35 as drawn around the attachment arm 200 as depicted in the drawings. In the preferred embodiment, shown in the drawings, the container attachment means is formed as a simple hook member 310 that is affixed to some portion of the outer surface of the attachment arm 200 between the first end and second end of such attachment arm, as seen. More specifically as shown is a container grasping member in the form of a hook member 310 has a first end and a second end, with the first end being rigidly embedded in a portion of the container attachment arm 200. Further, as seen, the container grasping member 300 projects outwardly a distance from the attachment arm 200. As can be seen from the drawings, the second end of the container grasping member 300 is formed in a curved manner so as to form a hook shape. It is to be stated that the container grasping member 300 may be other than hook-shaped, and may be similarly disposed and solely affixed to a portion of the upright handle member. The position of the grasping member can thus be disposed in any location so long as it can be attached to and grasp a portion of the container member 35.

In order to secure the temporary container 35 in the form of a plastic bag, or otherwise, to the base member 20, the following operational steps are used. Prior to this descriptive aspect is to be noted that the container to be drawn around the base member is preferably a pliable member, such as a small flexible container 35, as indicated above. For purposes of implementing the preferred embodiment of the subject invention, the container 35 has an opening 40 leading to an otherwise enclosed spatial area 46, with the internal spatial area lined by an internal surface 350 of container 35. An outer surface 360 of such container extends from the outer circumferential edge 45 of the opening 40 which spatial area extends to the bottom enclosed portion 390 of the container 35.

The process of affixing container member 35 to the subject apparatus is accomplished by the following steps. First, the container 35, in the form of a flexible bag with an opening 40 and a bottom enclosed surface 390, is grasped manually. The first step is to take the container 35 and fold the circumferential edge of opening 40 around the outer surface 360 towards the bottom portion 390 of the container. In the preferred embodiment of the subject invention, it is considered optimal, although not critical, to implementation of the subject invention, that the fold be made approximately one-half the size or length of the container 35. More specifically, as shown in the drawings, it is considered desirable to fold the container 35 over to one-half of its length so that the opening edge 45 of the container 35 is folded back to meet the bottom portion 390, the enclosed end of the container, as set forth in the drawings. Demonstrated graphically in the series of steps shown in FIGS. 3 and 4 of the drawings is the process of taking the container 35 and folding it back to a position as described above. Upon completion of the process of folding back the container member 35, a new opening 400 remains in the container similar in size and shape to original opening 40, and as a result of the folding process, the container will retain its original bottom portion at a position where it originally existed. Furthermore, the container will now have a limited internal spatial containment area between the new outer opening 400 of the folded container over which the top half of the container. More directly, once the top half of the container is folding over the remaining portion of the container, as seen graphically in FIG. 3, a gap 440 or separation, circumferential in extent, exists between the lower part of the container and the upper part of the container as folded over the lower portion. This gap is circumferential in extent and extends for approximately the length of the resultant container as folded back, as described above, with such gap having a circumferentially opening exposed from the posterior portion of the container.

Once the container member 35 is in the position of being folded back, it is then emplaced around the base member 20 according to the following steps. First, the container 35 now folded back over itself as described above, is inserted over the frontal position of the base member 20 by threading a portion of the circumferential gap 440 of the folded container around the upper surface and lower surface of the base member, starting at the frontal portion, and then the folded container 35 is pulled all the way or substantially all the way around the base member 20 until it contacts the handle member 100. Contact with the handle member is not critical, however.

To accomplish this end of drawing the container 35 over part of the apparatus 10 and securing it to the apparatus 10, the user will grasp an outer circumferential surface portion of the container, preferably that portion above the upper surface of the base member. FIGS. 3 and 4 demonstrate these steps of grasping and pulling upwardly a portion of the folded container 35 and thence wrapping the grasped portion of the container 35 around the longitudinally extending attachment arm 200 as seen.

Once the container is pulled upwardly and drawn and pulled circumferentially over the upper circumferential surface of the longitudinally extending attachment arm 200, as seen in FIG. 3, the distal part of the container member is affixed in part to the attachment means 300 on the attachment arm and once so attached, the attachment arm is rotated clockwise for further securing purposes.

Once the folded container is so drawn around the base member 20 as seen in FIG. 3, the new opening 400 of the folded container is now exposed facing frontally from the frontal portion of the base member 20 so that the opening is exposed, as stated, toward the front of the base member.

For this purpose, when the folded container is secured to the retrieval device for usage, it is essential that the folded container be secured in such a manner that the opening of the folded container extending or leading into the resultant internal container space will be openly extended to some degree to receive debris.

In summary, the subject invention is an apparatus for retrieving debris from the ground employing a flexible open container member for receiving and holding any debris that is retrieved by the container member comprising:

a. a base member, such base member having an upper surface and a lower surface, such based member further having a front end, a posterior end, and such base member further having a first side edge and a second side edge;

b. an upright longitudinally extending handle member having an upper end and a lower end, with the lower end of said handle member being rigidly affixed to a portion of the base member, such handle member being aligned perpendicular to the upper surface of such base member;

c. longitudinally extending container attachment member affixed to the handle member, such container attachment member having means thereon to grasp a portion of a container member employed around such base member.

Yet another summary of the subject invention is a debris retrieval device for retrieving debris from the ground with an open container member to be temporarily attached to such device comprising:

a. a longitudinally base member having a frontal end and a posterior end, such base member having a first lateral side edge and a second lateral side edge, which second lateral side edge opposes the front lateral side edge.

b. a longitudinally extending handle means affixed to a portion of such based member;

c. a longitudinally extending container attachment arm having a first end and a second end with such attachment arm being rotatably mounted in such handle member.

The subject invention can be further summarized as a debris retrieval device for retrieving debris from the ground with an open container member to be temporarily attached to such device comprising:

a. a longitudinally base member having a frontal end and a posterior end, such base member having a first lateral side edge and a second lateral side edge, which second lateral side edge opposes the first lateral side edge;

b. longitudinally extending handle means affixed to a portion of such base member;

c. a longitudinally extending container attachment arm having a first end and a second end; with such attachment arm being so mounted in said handle member.

Further, the subject invention can be summarized as a method of retrieving debris from the ground using a base member having an attached handle member and wherein said base member has a front end and a posterior end for pulling flexible container with an opening over the base member from the posterior end of the container member with the opening of the flexible container disposed towards front end of the base member comprising the steps of pulling a container folded over on itself around the base member to expose the resultant container opening and securing the container to a portion of the handle member.

Moreover, another summary of the subject invention is that it is a device to help retrieve animal waste from the ground and expedite the process of containerizing the animal waste comprising:

a. a base member having an upper surface and a lower surface, said base member having a front portion and a rear portion, and such base having two opposing lateral sides;

b. a longitudinally extending handle means having an upper portion and a lower portion of such handle means being affixed to a portion of the base member;

c. container attachment means affixed to a portion of the handle means.

And yet another summary of the subject invention is that it is a device for retrieving and holding temporarily animal waste in an open container to be temporarily affixed to such device comprising:

a. a base member having a first end and a second end, such base members having a first lateral side edge and a second lateral side edge opposing said first lateral side edge, and such base member having an upper surface and a lower surface;

b. a longitudinally extending handle means affixed to a portion of such base member;

c. a longitudinally extending container attachment arm having a first end and second end, with such attachment member being rotatably mounted to such handle means;

d. container attachment means affixed to the attachment arm.

Furthermore, the subject device may be described as a debris retrieval apparatus adapted to receive a flexible container around a portion of the apparatus for collecting debris in the container comprising:

a. a base member, such base member having an upper surface and a lower surface, with such base member having a frontal portion and a posterior portion;

b. a handle member having a first end and a second end, with said first end of such handle member being affixed to a portion of such base member;

c. container attachment members affixed to a portion of such handle member to affix and secure a part of a container to said apparatus.

What is claimed is:

1. An apparatus for retrieving debris from the ground employing a flexible open container member for receiving and holding any debris that is retrieved by the container member comprising:

a. a base member, said base member having a flat upper surface and a lower surface, said base member having a front end, a posterior end, and said base member further having a first side edge and a second side edge;

b. an upright longitudinally extending handle member having an upper end and a lower end, with the lower end of said handle member being rigidly affixed to a portion of the base member, said handle member being aligned perpendicular to the upper surface of said base member;

c. a longitudinally extending container attachment member having an outer surface and being rotatably mounted on said handle member, said container attachment member having hook means thereon positioned to grasp a portion of a flexible container employed adapted to be placed on and in a folded relation under and around said base member with the open end of the container facing front and away from the front end of said base member said container attachment member being affixed parallel to the upper surface of said base member and aligned perpendicular to said handle member with said attachment member extending towards the front end of said base member.

2. A debris retrieval device for retrieving debris from the ground with an open flexible container member having an opening to be temporarily attached to said device comprising;

a. a longitudinal base member having a frontal end and a posterior end, said a member having a first lateral side edge and a second lateral side edge, which second lateral side edge opposes the first lateral side edge with said base member having an upper surface and a lower surface;

b. a longitudinally extending handle member affixed to a portion of said base member;

c. a longitudinally extending container attachment arm having an outer cylindrically-shape surface and a first end and a second end with said attachment arm being rotatably mounted in said handle member for rotation about an axis which is perpendicular to said handle member, said attachment arm being aligned parallel to the upper surface of said base member, said attachment arm being projected over a portion of said upper surface of said base member, and wherein said attachment arm has a hook member projecting from the outer cylindrical surface of said attachment arm, said hook member being adapted to grasp a portion of said open flexible container;

d. means affixed on said attachment arm adapted to attach a portion of a flexible container to said attachment arm when said container is placed on said base member and one side is pulled under the base member with the opening of said flexible container exposed toward the frontal end of said base member.

3. A debris retrieval device for retrieving debris from the ground with an open container to be temporarily attached to said device comprising:

a. a longitudinal base member having a frontal end and a posterior end, said base member having a first lateral side edge and a second lateral side edge, which second lateral side edge opposes the first lateral side edge, said base member having an upper surface;

b. a longitudinally extending handle member affixed to a portion of said base member;

c. a longitudinally extending container attachment arm having an outer surface and having a first end and a second end with said attachment arm being rotatable mounted on said handle member for rotation about an axis that is parallel to the surface of said base member extending in a direction that is aligned with said upper surface of said base member, said attachment arm having container attachment means in the form of a hook member affixed to the outer surface of said container attachment arm to grasp a portion of the container member so that when a flexible container is pulled on the base member with the opening of said flexible container member exposed towards the frontal end of said base member the container can be attached in part to said container attachment arm.

4. A device for retrieving and holding temporarily animal waste in an open container to be temporarily affixed to said device comprising;

a. a base member having a first end and a second end, said base member having a first lateral side edge end a second lateral side edge opposing said first lateral side edge, and said base member having an upper surface and a lower surface;

b. a longitudinally extending handle member affixed to a portion of said base member;

c. a longitudinally extending container attachment arm having a first end and a second end, with said attachment arm being rotatably mounted to said handle member with longitudinal axis of rotation and with said container attachment arm extending from said handle member being aligned parallel to the upper surface of said base member;

d. container attachment means affixed to the attachment arm, said container attachment means having an outwardly extending grasping member adapted to grasp a portion of the open container, said outwardly extending grasping member being capable of attaching a portion of said container to said container attachment means.

5. A device to help retrieve animal waste from the ground and expedite the process of containerizing animal waste in a flexible container comprising;

a. a base member having an upper surface and a lower surface, said base member having a front portion and a rear portion, and said base having two opposing lateral sides;

b. a lagitudinally extending handle means having an upper portion and a lower portion of said handle means being affixed to a portion of the base member;

c. a container attachment member having an outer cylindrical surface affixed to a portion of the handle means said container attachment member comprising a longitudinally extending member of cylindrical configuration that is rotatable mounted on said handle means to project over and parallel to the upper surface of said base member with said container attachment member having a projecting fastening member affixed to the outer cylindrical surface of said container attachment member, which fastening member is structured to grasp a portion of said flexible container.

* * * * *